US010648783B2

(12) United States Patent
Pichler et al.

(10) Patent No.: US 10,648,783 B2
(45) Date of Patent: May 12, 2020

(54) PROJECTILE

(71) Applicant: Hirtenberger Defence Europe GmbH, Hirtenberg (AT)

(72) Inventors: Peter Pichler, Seibersdorf (AT); Christian Müller, Markt Piesting (AT); Martin Emsenhuber, Gobelsburg (AT); Bernhard Mayer, Schleinbach (AT)

(73) Assignee: Hirtenberger Defence Europe GmbH, Hirtenberg (AT)

( * ) Notice: Subject to any disclaimer, the term of this patent is extended or adjusted under 35 U.S.C. 154(b) by 0 days.

(21) Appl. No.: 16/532,597

(22) Filed: Aug. 6, 2019

(65) Prior Publication Data

US 2019/0360789 A1 Nov. 28, 2019

Related U.S. Application Data

(63) Continuation of application No. 15/126,018, filed as application No. PCT/AT2015/050062 on Mar. 10, 2015, now Pat. No. 10,415,939.

(30) Foreign Application Priority Data

Mar. 14, 2014 (AU) ..... A 50190/2014

(51) Int. Cl.
*F42B 12/28* (2006.01)
*F42B 12/22* (2006.01)

(52) U.S. Cl.
CPC ..... *F42B 12/28* (2013.01); *F42B 12/22* (2013.01)

(58) Field of Classification Search
CPC ..... F42B 12/28; F42B 12/22
(Continued)

(56) References Cited

U.S. PATENT DOCUMENTS 29,995 A 9/1860 Rice
37,661 A 2/1863 Gerardin
(Continued)

FOREIGN PATENT DOCUMENTS

EP 0 328 877 A1 8/1989
FR 2 617 586 B1 12/1989
(Continued)

OTHER PUBLICATIONS

International Preliminary Report on Patentability for Application No. PCT/AT2015/050062, dated Oct. 3, 2016.
(Continued)

*Primary Examiner* — Michelle Clement
(74) *Attorney, Agent, or Firm* — Wolf, Greenfield & Sacks, P.C.

(57) ABSTRACT

The invention relates to a projectile (1), which has a projectile body (2) featuring a recess (5) for receiving an explosive, wherein the projectile body (2) has a rotation-symmetrical shell surface (7), at least in sections, which is surrounded, at least in sections, by several ring-shaped elements (8) provided with predetermined break points, wherein fragments (12) formed upon breakup of the elements (8) are predefined via the predetermined break points, said fragments (12) being connected to one another in a ring-shaped connecting portion (11) for forming the ring-shaped element (8), and the freely projecting ends (13) of the fragments (12) being at least partially arranged in a common orthogonal plane (13') to a longitudinal axis (8') of the ring-shaped element (8), wherein this orthogonal plane (13') is arranged diverging from an orthogonal plane (11') defined by the ring-shaped connecting portion (11), as well as to a corresponding ring-shaped element (8) for the projectile (1).

14 Claims, 6 Drawing Sheets

(58) Field of Classification Search
USPC ..... 102/495
See application file for complete search history.

(56) References Cited

U.S. PATENT DOCUMENTS

| | | | | |
|---|---|---|---|---|
| 90,164 | A | 5/1869 | Gibson | |
| 96,595 | A | 11/1869 | Jobson | |
| 174,771 | A | 3/1876 | Broadwell | |
| 374,874 | A | 12/1887 | Koerner | |
| 1,017,928 | A | 2/1912 | Tocik | |
| 1,325,706 | A | 12/1919 | Todisco | |
| 2,023,158 | A | 12/1935 | Williams | |
| 2,401,483 | A | 6/1946 | Hensel et al. | |
| 2,413,008 | A | 12/1946 | Taglialatela | |
| 2,798,431 | A | 7/1957 | Semon et al. | |
| 2,933,799 | A | 4/1960 | Semon | |
| 2,972,950 | A | 2/1961 | Welanetz | |
| 2,998,779 | A | 9/1961 | MacRoberts | |
| 3,000,309 | A | 9/1961 | Zapf | |
| 3,425,350 | A | 2/1969 | Zunino et al. | |
| 3,566,794 | A | 3/1971 | Pearson et al. | |
| 3,677,183 | A | 7/1972 | Talley | |
| 3,722,414 | A | 3/1973 | Talley | |
| 3,820,464 | A | 6/1974 | Dixon | |
| 3,978,796 | A | 9/1976 | Hackman | |
| 4,068,590 | A | 1/1978 | Pearson | |
| 4,305,333 | A | 12/1981 | Altenau et al. | |
| 4,312,274 | A | 1/1982 | Zernow | |
| 4,381,692 | A | 5/1983 | Weintraub | |
| 4,398,467 | A | 8/1983 | Leigh | |
| 4,515,083 | A | 5/1985 | Caruso | |
| 4,603,637 | A | 8/1986 | Snide et al. | |
| H000238 | H * | 3/1987 | Adams | 102/493 |
| 4,664,035 | A | 5/1987 | Osofsky | |
| 4,671,180 | A | 6/1987 | Wallow et al. | |
| 4,745,864 | A | 5/1988 | Craddock | |
| 4,899,661 | A | 2/1990 | Kaelin | |
| 5,095,821 | A | 3/1992 | Merz | |
| 5,117,759 | A | 6/1992 | Henderson et al. | |
| 5,131,329 | A | 7/1992 | Lips et al. | |
| 5,157,225 | A | 10/1992 | Adams et al. | |
| 5,834,683 | A | 11/1998 | Benvegnu' | |
| 6,295,934 | B1 | 10/2001 | Tepera et al. | |
| 6,484,642 | B1 | 11/2002 | Kuhns et al. | |
| 6,817,299 | B1 | 11/2004 | Cooke | |
| 6,962,113 | B1 | 11/2005 | Carlson et al. | |
| 7,743,707 | B1 | 6/2010 | Melin et al. | |
| 7,891,297 | B1 | 2/2011 | Rohr | |
| 8,161,884 | B1 | 4/2012 | Kokodis et al. | |
| 8,276,520 | B1 | 10/2012 | Fong et al. | |
| 8,286,558 | B2 | 10/2012 | Marx | |
| 8,622,001 | B1 | 1/2014 | Patel et al. | |
| 8,973,503 | B2 | 3/2015 | Dunaway et al. | |
| 9,470,495 | B2 | 10/2016 | Kravel | |
| 10,415,939 | B2 | 9/2019 | Pichler et al. | |
| 2005/0022687 | A1* | 2/2005 | Flanagan | F42B 12/32 102/494 |
| 2005/0087088 | A1* | 4/2005 | Lacy | F42B 12/24 102/495 |
| 2009/0078147 | A1* | 3/2009 | Ronn | F41H 11/02 102/494 |
| 2010/0199875 | A1* | 8/2010 | Weihrauch | F42B 12/208 102/492 |
| 2012/0186482 | A1* | 7/2012 | Lloyd | F42B 12/60 102/495 |
| 2012/0192754 | A1* | 8/2012 | Scheid | F42B 12/24 102/495 |
| 2012/0266773 | A1* | 10/2012 | Eckstein | F42B 5/03 102/506 |
| 2013/0055917 | A1* | 3/2013 | Menefee, III | F42B 7/08 102/334 |
| 2014/0299012 | A1* | 10/2014 | Odintsov | F42B 12/32 102/491 |
| 2016/0178336 | A1* | 6/2016 | Jennett | F42B 12/207 102/506 |
| 2019/0041176 | A9 | 2/2019 | Pichler et al. | |

FOREIGN PATENT DOCUMENTS

| | | | |
|---|---|---|---|
| FR | 2 975 482 | A1 | 11/2012 |
| GB | 2 052 694 | A | 1/1981 |

OTHER PUBLICATIONS

International Search Report for International Application No. PCT/AT2015/050062 dated Jun. 10, 2015.
Written Opinion for Application No. PCT/AT2015/050062, dated Jun. 10, 2015.

* cited by examiner

PROJECTILE

This Application is a Continuation of U.S. application Ser. No. 15/126,018, filed Sep. 14, 2016, entitled "PROJECTILE", which is a national stage filing under 35 U.S.C. 371 of International Patent Application Serial No. PCT/AT2015/050062, filed Mar. 10, 2015. Foreign priority benefits are claimed under 35 U.S.C. § 119(a)-(d) or 35 U.S.C. § 365(b) of Austrian application number A 50190/2014, filed Mar. 14, 2014.

The invention relates to a projectile, which has a projectile body featuring a recess for receiving an explosive, wherein the projectile body has a rotation-symmetrical, preferably cylindrical, shell surface, at least in sections, which is surrounded, at least in sections, by several ring-shaped elements provided with predetermined break points, wherein fragments formed upon breakup of the elements are predefined via the predetermined break points, said fragments being connected to one another in a ring-shaped connecting portion for forming the ring-shaped element.

During explosions of projectiles, fragments having different masses are formed upon natural breakup. A disadvantage here is that fragments of a very low mass have only little effect while fragments of high mass have a very large range of effect which often exceeds the desired range of effect. As a consequence, fragments of high mass may cause undesired collateral damage outside of the target area whereas the fragments of low mass do not contribute to the effect in the target area. This means that both fragments of high mass and of low mass do not contribute to the effect in the desired target area, and are thus lost for the target area. For harmonising masses, various approaches are already known from the prior art.

A projectile of the initially mentioned type, in which ring-shaped elements have predetermined break points in order to produce fragments of a predefined size and mass upon explosion of the projectile, is known from EP 0 328 877 A, for example. Here, a plurality of rings is arranged on top of each other in order to form a shell made of fragments, with the rings featuring gaps having cylindrical insides or triangular cross-sections to determine the desired size of the fragments.

A similar design using substantially gear-shaped rings is known from FR 2 523 716 A, for example.

Furthermore, EP 273 994 B1 discloses a projectile having a plurality of rings featuring triangular gaps in their insides.

Comparable designs are known from DE 37 216 619 A as well as U.S. Pat. No. 8,276,520 B1.

A disadvantage of these projectiles known in the prior art is, however, that the fragments—even if they have the desired mass and/or size—are propelled substantially perpendicularly to the longitudinal axis of the rotation-symmetrical section of the projectile, so a great number of the fragments is not propelled into the desired target area.

Accordingly, it is the object of the present invention to provide a projectile of the initially mentioned type, in which the fragments are propelled from the projectile in such a way that the range in which the fragments have an effect is enlarged.

According to the invention, this is achieved by arranging the freely projecting ends of the fragments at least partially in a common orthogonal plane to a longitudinal axis of the ring-shaped element, wherein this orthogonal plane is arranged diverging from an orthogonal plane defined by the ring-shaped connecting portion.

In projectiles known up to now, the ring-shaped elements have been formed substantially disc-shaped, i. e. the freely projecting ends of the predefined fragments and the opposite end of the ring-shaped element where the fragments are connected to one another have been arranged in the same orthogonal plane. Due to this disc-shaped design known in the prior art, fragments are propelled substantially perpendicularly to the longitudinal axis of the usually cylindrical section of the projectile body upon explosion of the explosive received in the projectile body. As a consequence, provided that the projectile hits the ground in an angle of, for example, 45° and thus the explosive is ignited in this angular position, for instance when using a direct-action fuze, a considerable share of the fragments received on the projectile body is misdirected towards the ground, so the projectile has a comparably small range of effect and/or the scattering effect is inefficient.

Because of the inclination and/or curvature of the fragments according to the invention with respect to the longitudinal axis of the ring-shaped element and/or the longitudinal axis of the rotation-symmetrical section of the projectile body, the propelling direction is changed with respect to known projectiles, so the scattering effect and/or the range in which the fragments are efficient is enhanced considerably.

A particularly simple and efficient design with regard to the determination of the trajectory as well as to the production is obtained if the upper and the lower surface of at least a number of fragments are formed substantially smooth and parallel to one another, wherein the two surfaces include an angle other than 90° with respect to the orthogonal plane, defined by the ring-shaped connecting portion, to the longitudinal axis. In such a design, at least a subset of the fragments is formed substantially rectilinearly, i. e. not curved, in their cross-sections, so the trajectory may be determined well; on the other hand, the production of the disc-shaped elements may be done in a simple manner by pre-manufacturing ring-shaped discs in which at least a subset of the fragments is bent out from the plane of the ring-shaped connecting portion connecting the fragments.

Provided that all fragments include substantially the same angle of inclination with respect to an orthogonal plane, defined by the ring-shaped connecting portion, to the longitudinal axis, a particularly efficient design with regard to the production techniques is obtained, wherein all ring-shaped elements have substantially the same design. However, this does not mean that all ring-shaped elements are arranged in the same angle to the longitudinal axis of the cylindrical section of the projectile body, since preferably the arrangement of the ring-shaped elements is divided into at least two sections, wherein the arrangement and/or orientation of the ring-shaped elements in the first section is reversed with respect to the arrangement of the ring-shaped elements in the second section, and/or the ring-shaped elements in the two sections may be arranged mirrored about an orthogonal plane to the longitudinal axis of the rotation-symmetrical section of the projectile body.

As an alternative to the design of ring-shaped elements in which all fragments have the same angle of inclination, it is also possible for a subset of the fragments to include a first angle other than 90° with respect to the orthogonal plane defined by the ring-shaped connecting portion, and another subset to include a second angle, also other than 90° with respect to the orthogonal plane defined by the ring-shaped connecting portion. Preferably, the value of the second angle here equals that of the first angle, but the inclination of the fragments is mirrored about a plane extending through a ring-shaped connecting portion. This results in each ring-shaped element featuring two groups of fragments having different angles of inclination with respect to the plane defined in the ring-shaped connecting portion, so upon explosion of the explosive, fragments are propelled in a different direction in each ring-shaped element.

Tests showed that a particularly efficient propelling direction, in which the effective range of the projectile may be improved considerably with respect to previously known projectiles, is obtained if the upper and the lower surface of the fragments include an angle between 5° and 70°, preferably between 15° and 45°, in particular between 25° and 35°, with respect to a plane defined by the ring-shaped connecting portion. This advantageous inclined arrangement of the fragments is based on the fact that the projectile is usually activated in an angle between 45° and 85° with respect to the ground by means of either a direct-action fuze or a delay-action fuze. This means that the projectile usually has an angle of inclination of approx. 45° to 85° with respect to the ground when it is activated. Advantageously, the inclination of the fragments between 5° and 70° makes it possible to propel especially those fragments, which are usually (mis) directed towards the ground because of the inclination of the projectile upon ignition of the explosive and, consequently, do not make a useful contribution, in an angle other than 90° with respect to the shell surface of the projectile body, thus improving the scattering effect considerably.

Regarding a simple and efficient production of the ring-shaped elements in terms of manufacturing techniques, it is advantageous for each of the ring-shaped elements to have a plurality of grooves representing predetermined break points. Here, a substantially disc-shaped, ring-shaped element may be produced, in which grooves are made by punching, milling, lasing or, if desired, (wire) erosion in order to establish a controlled fragmentation of the ring-shaped elements.

In order to predefine fragments the main extension direction of which is substantially in the radial direction of the ring-shaped element and, thus, in the direction of the momentum initiated by the explosive, it is favourable for the axes of longitudinal extension of each groove to be substantially in the radial direction of the ring-shaped element.

Regarding a simple and efficient production it is favourable for the grooves to have a substantially rectangular cross-section.

The ground of the substantially rectangular grooves may have different designs. It is particularly advantageous, for example, if the grooves are made by means of wire erosion since in this case the grooves can have a relatively small width and, as a consequence, comparably low material loss occurs in the production of the predetermined break points. As a result of the typically round cross-section of the wire, the grooves will have a ground in the shape of a circular arc.

In order to define the fragmentation of the fragments from the ring-shaped element upon explosion especially accurately, in particular regarding the breakup in the circumferential direction, it is advantageous for the grooves to have a ground in the shape of an acute angle.

Provided that the grooves extend outwardly from an inner surface of the ring-shaped elements defined by an inner radius, ring-shaped elements having grooves and/or predetermined break points which are not visible on the outside of the ring-shaped elements are formed in an advantageous way. Advantageously, this means that providing an outer (protective) cover may be omitted.

In this case, it is particularly favourable for the ring-shaped connecting portion to have a substantially full-faced outer shell surface, so a substantially closed, preferably cylindrical outer shell surface is obtained without the need to take further precautions when arranging said ring-shaped elements on top of one another.

In order to obtain a substantially smooth outer shell surface by means of a plurality of ring-shaped elements arranged on top of one another, it is favourable for the outer shell surface of the ring-shaped elements to have an angle other than 90° towards both an upper and a lower surface of the ring-shaped connecting portion, so the shell surface extends substantially parallel to the cylindrical shell surface of the projectile body.

Due to this substantially smooth-faced design of an outer shell surface by means of a plurality of ring-shaped elements, the deposition of dirt and/or a forming of contact corrosion or the like may be avoided in an advantageous manner, in particular when glueing the ring-shaped elements to one another and/or applying a coating such as a layer of paint.

Regarding the method, such ring-shaped elements are produced, in particular, as follows:

First, substantially planar ring-shaped discs are produced, in which predetermined break points are made by the aforementioned steps (eroding, punching, milling, etc.), leaving a ring-shaped connecting portion. Then, the freely projecting ends of the predefined fragments are bent out from the plane defined by the ring-shaped connecting portion, thus defining the desired propelling direction.

As a result, however, the outer shell surface of the previously disc-shaped elements is then located vertically with respect to the inclined fragments and/or the ring-shaped connecting portion, so that when arranging such ring-shaped elements on top of one another, each element forms a sharp-edged protrusion having a substantially triangular cross-section. This is disadvantageous with regard to the forming of corrosion and the possibility for applying a (tight) protective cover and/or coating, and ballistic disadvantages will occur in conjunction with this as well.

Therefore, in order to obtain a substantially closed, smooth outer shell surface in which ring-shaped elements arranged on top of one another, the sharp-edged triangular protrusions of the ring-shaped elements are removed in an advantageous manner, preferably by a turning method and after glueing the ring-shaped elements to one another, so the desired substantially smooth outer shell surface is obtained. Afterwards, it may be provided with a protective paint known from the prior art or the like.

Regarding the increase of the effective range of the projectile, it is favourable for the ring-shaped elements close to the ground to be propelled in a different angle than the ring-shaped elements far from the ground, so it is advantageous to arrange a positioning ring between a first subset and a second subset of the ring-shaped elements. Using the positioning ring, the ring-shaped elements may be divided into at least two subsets, which preferably have different propelling directions, in a simple manner.

In order to obtain a compact positioning of these ring-shaped elements in a substantially mirrored arrangement, it is favourable for the positioning ring to have an upper and a lower contact surface extending inclined with respect to an orthogonal plane of the longitudinal axis of the rotation-symmetrical section of the projectile body, with the positioning ring preferably designed as a mirror image about a central orthogonal plane of the longitudinal axis of the rotation-symmetrical section.

The object according to the invention is also achieved, in particular, by a ring-shaped element for a projectile according to any one of the preceding claims, having several predetermined break points, at least in sections, defining fragments formed upon breakup of the element, wherein the freely projecting ends of the fragments are arranged, at least partially, in a common orthogonal plane to a longitudinal axis of the ring-shaped element and this orthogonal plane is arranged diverging from an orthogonal plane defined by the ring-shaped connecting portion.

The invention is discussed in more detail by means of preferred exemplary embodiments, however without being limited to them, below. In the individual drawings:

FIG. 1 shows a cross-section of a projectile according to the invention;

FIG. 1*a* shows a cross-section of an alternative projectile according to the invention;

Figure 1:
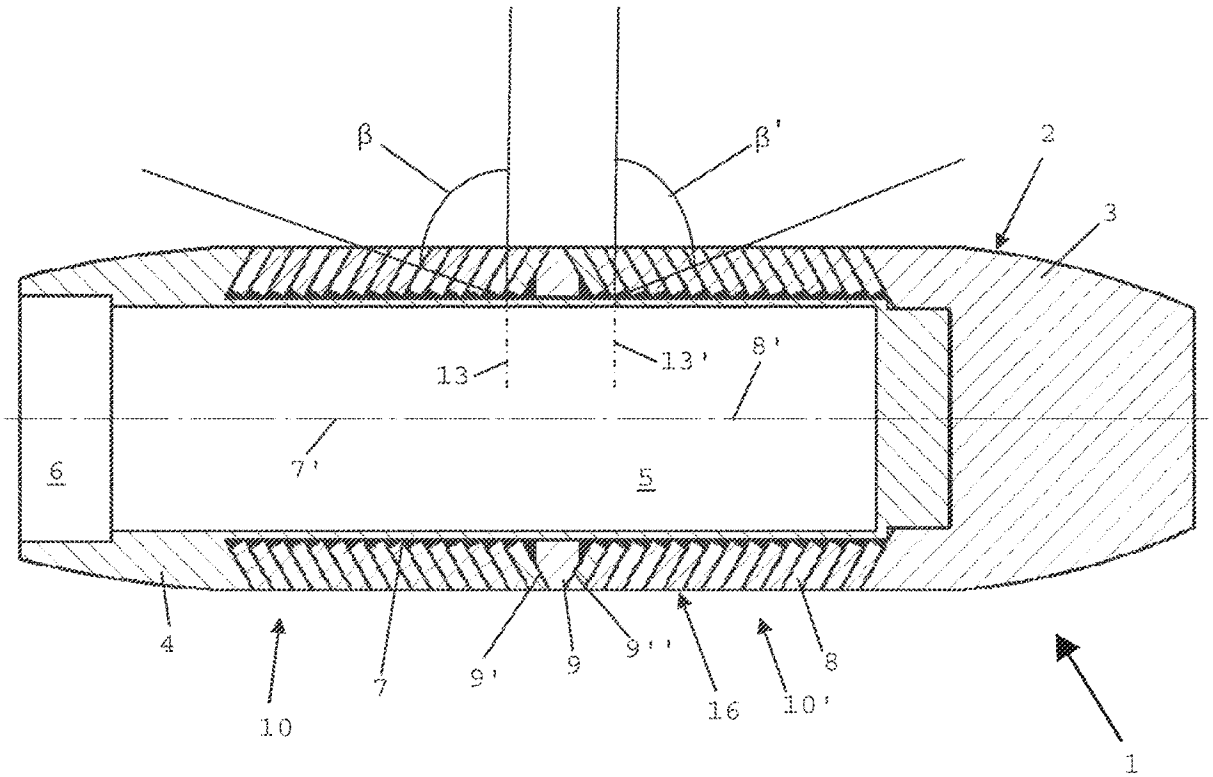

In FIG. 1 a projectile 1 according to the invention can be seen, featuring a projectile body 2 having a rear part 3 and a blasting pipe 4. The blasting pipe 4 has a recess 5 for receiving the explosive and an adjoining recess 6 for receiving a fuze (not shown). A direct-action fuze or a delay-action fuze may be provided, in particular.

As can be seen in the cross-sectional view according to FIG. 1, the blasting pipe 4 in the exemplary embodiment shown has a substantially cylindrical shape, so in a section of the projectile 2 a rotation-symmetrical, in the present case cylindrical, shell surface 7 is formed, on which a plurality of ring-shaped elements 8 may be received in a simple manner. The outer diameter of the cylindrical shell surface 7 and the inner diameter of the ring-shaped elements 8 are chosen such that the ring-shaped elements 8 may be pushed and/or threaded over the substantially cylindrical pipe element with play in a simple manner. As a consequence, in assembled state, a longitudinal axis 7' of the cylindrical shell surface 7 of the blasting pipe 4 substantially coincides with a longitudinal and/or rotational axis 8' of the ring-shaped elements 8.

Furthermore, it can be seen in FIG. 1 that the ring-shaped elements 8 are divided into two groups and/or subsets 10, 10' by means of a positioning ring 9. In the exemplary embodiment shown all ring-shaped elements 8 are of the same design, but the spatial arrangement of the ring-shaped elements 8 in the first group 10, which is located closer to the fuze receiving portion 6, is in opposition to the arrangement of the ring-shaped elements 8 in the second subset and/or group 10'. By this, the scattering angle of the fragments upon explosion is further improved, as described in more detail below.

Figure 1A:
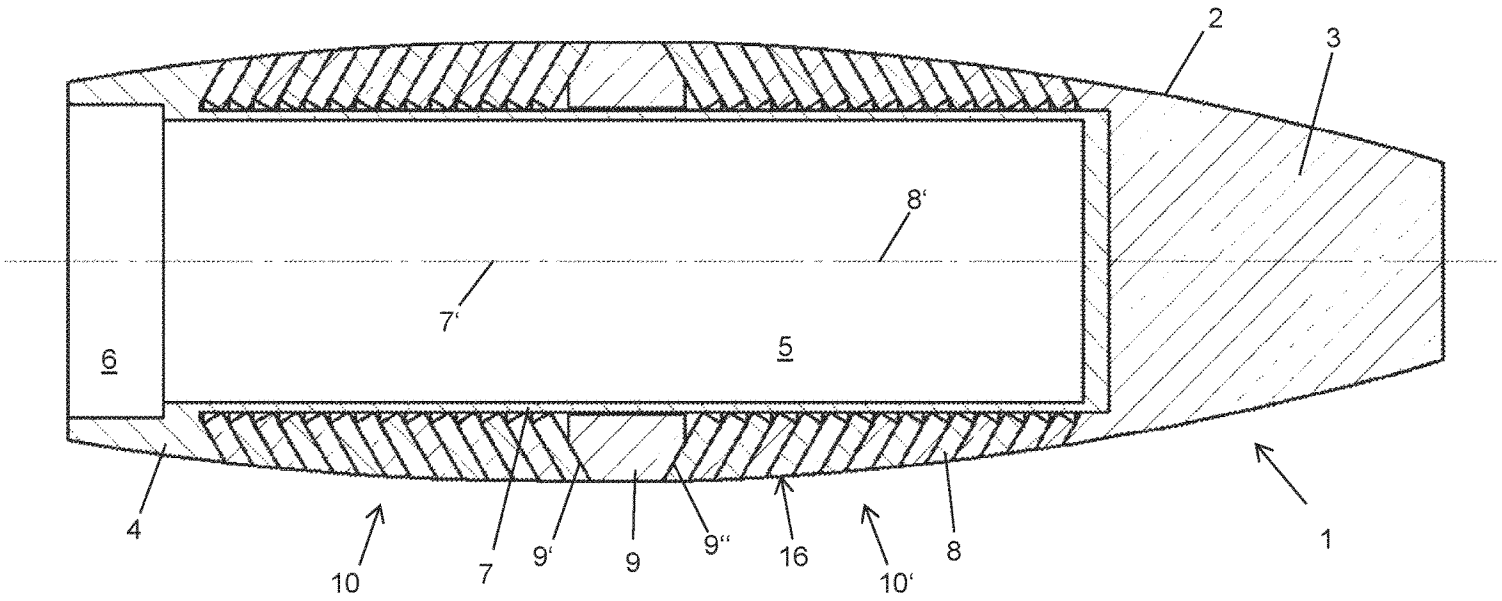

In FIG. 1*a* an alternative embodiment of projectile 1 according to the invention can be seen, whereas this embodiment provides for a throughout convex shape of the outer shell surface 16. The outer shell surface 16 is achieved in a central section by providing ring-shaped elements 8 having substantially the same inner diameter as the cylindrical shell surface 7, yet having different outer diameters. The outer diameters of the ring-shaped elements 8 are defined such that the in the area of the positioning ring 9 advantageously projectile 1 has the largest diameter.

By way of this convex shape of the outer shell surface 16 advantageously particularly favourable aerodynamics are achieved, which substantially correspond to the aerodynamic shape of other projectiles (without ring-shaped fragmented elements). Furthers by way of this arrangement additionally the enlargement of the scattering angle as aimed by the invention is further promoted.

Figure 2:
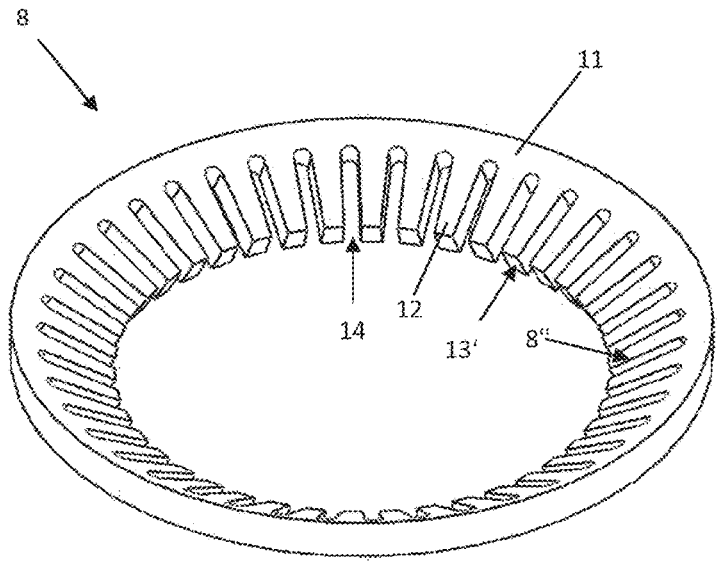
FIG. 2 shows a perspective view of a ring-shaped element.
Figure 3:
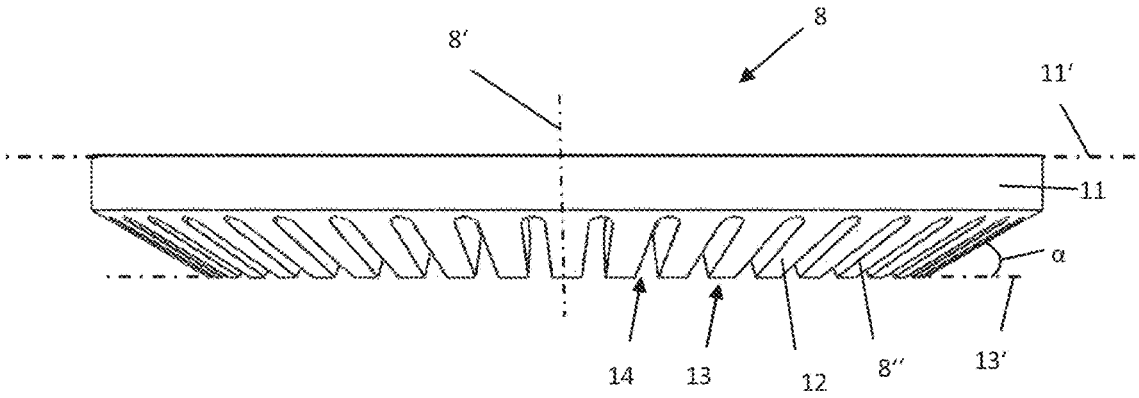
FIG. 3 shows a side view of the ring-shaped element according to FIG. 2.
Figure 4:
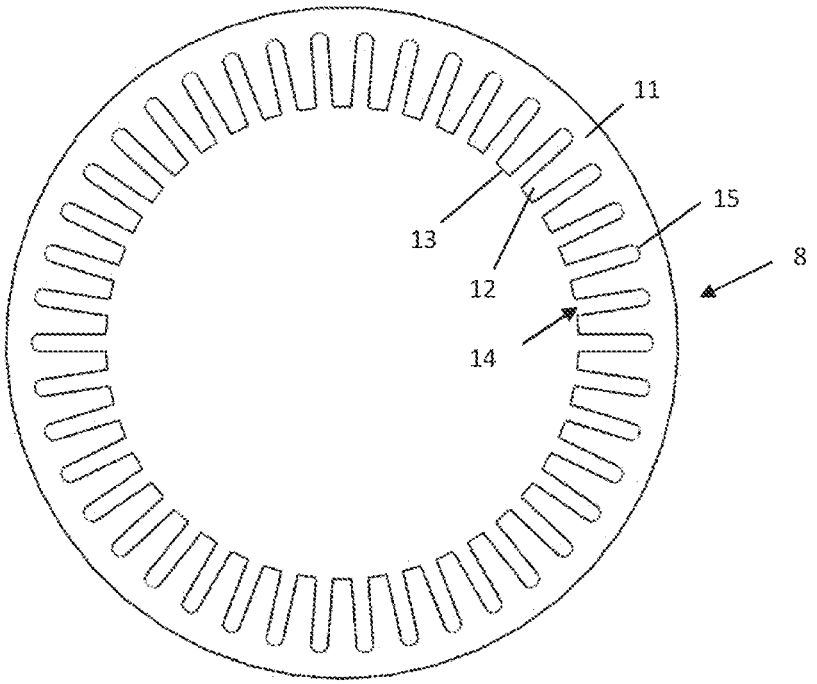
FIG. 4 shows a plan view of the ring-shaped element according to FIGS. 2 and 3.
Figure 5:
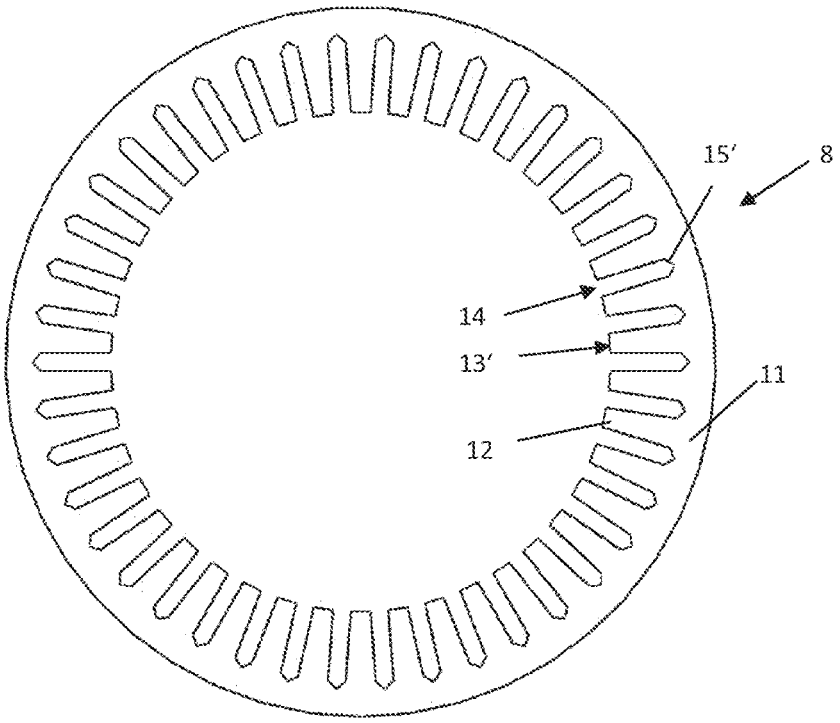
FIG. 5 shows a plan view of an alternative design of the ring-shaped element.

FIGS. 2 to 4 show a first possible design of the ring-shaped elements 8 according to the invention.

As can be seen, a ring-shaped connecting portion 11 is formed on the outside here, from which a plurality of fragments 12, each having a freely projecting end 13, extends to the inside.

As can best be seen in the side view according to FIG. 3, the orthogonal plane 11', defined by the ring-shaped connecting portion 11, to the longitudinal axis 8' is arranged diverging from the orthogonal plane 13' defined by the freely projecting ends of the fragments 12. According to this, the ring-shaped elements 8 designed according to the invention are—in contrast to what is known from the prior art—not formed as substantially flat, disc-shaped elements, but according to the invention the ring-shaped elements 8 have fragments 12 inclined with respect to the orthogonal plane 11' and/or the shell surface 7 of the blasting pipe 4 in order to change the propelling direction of the fragments 12 upon ignition of the explosive provided in the recess 5 in such a way that the number of the effective fragments 12 is increased due to their propelling direction.

Here, the ring-shaped elements 8 according to the invention are preferably made of ring-shaped discs, which ring-shaped discs are then deformed, preferably by means of a stamping method, in order to determine the inclination of the fragments 12 in the exemplary embodiment shown in an angle $\alpha$ of substantially 30° with respect to an orthogonal plane 11' and/or 13'.

Before this deformation is carried out, preferably by means of stamping, it is advantageous to produce the predetermined break points in the form of grooves 14 in the (yet) ring-shaped discs, which represent an intermediate product in the production of the ring-shaped elements 8 according to the invention.

Depending on the desired design of the grooves 14, different methods may be used for this. In the exemplary embodiment shown in FIGS. 2 to 4, the desired shape of the grooves may be produced in a particularly simple and efficient way by punching.

Of course, the possible methods for groove production also depend on the material selection for the ring-shaped elements 8; preferably, a suitable iron material meeting the desired requirements in conjunction with the forming of fragments in terms of hardness and toughness is selected for the design according to the invention. Such an iron material has good basic punching capabilities, too.

Moreover, the dimensions of the ring-shaped disc element, which serves as an intermediate product for the ring-shaped elements according to the invention, are selected such that a cuboid-shaped fragment design, in particular a cubist fragment design, is obtained.

Figure 6:
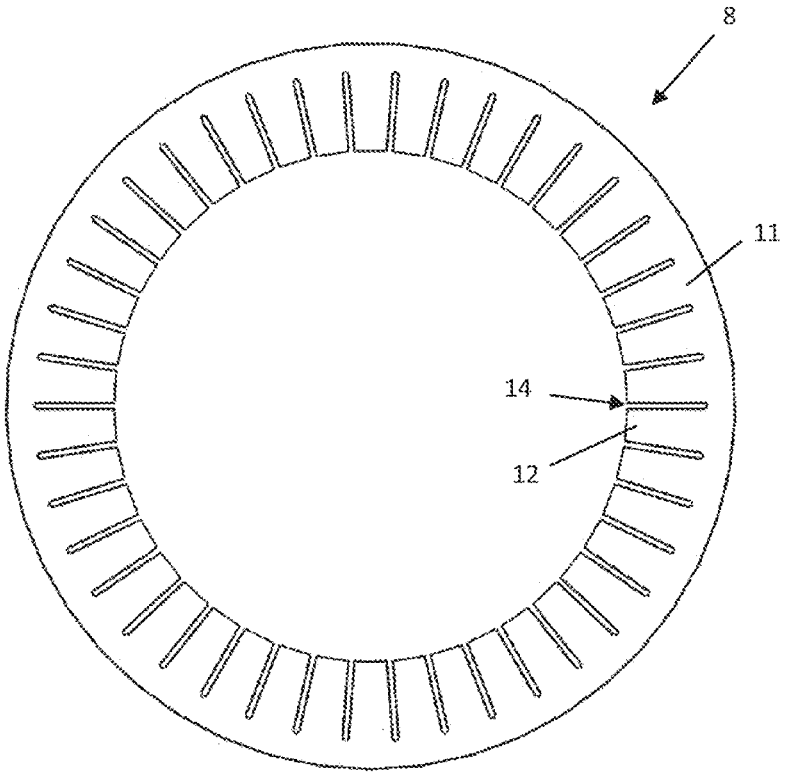
FIG. 6 shows a plan view of a further alternative design of the ring-shaped element.
Figure 7:
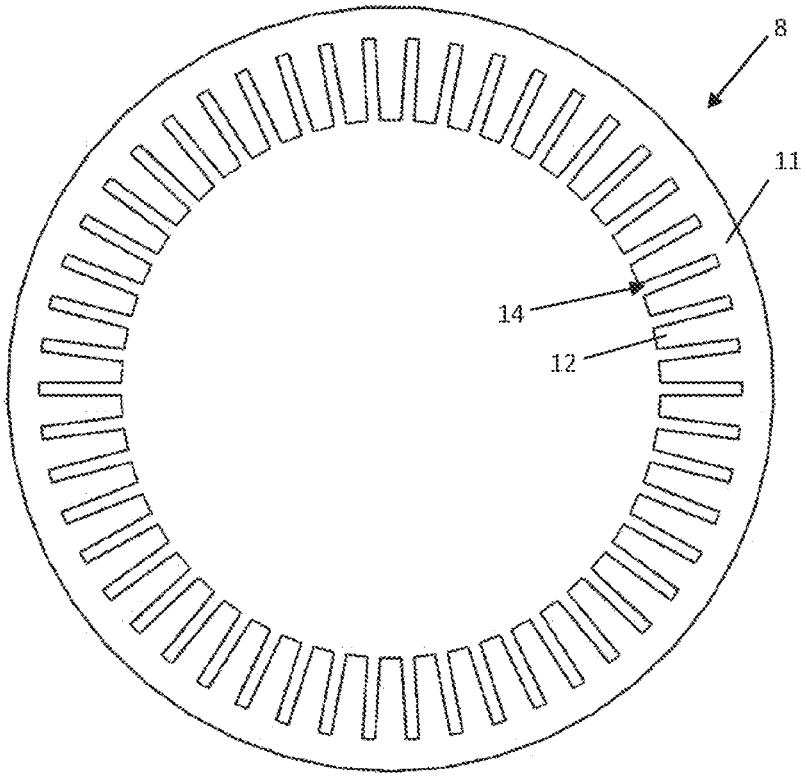
FIG. 7 shows a plan view of a further alternative design of the ring-shaped element.
Figure 8:
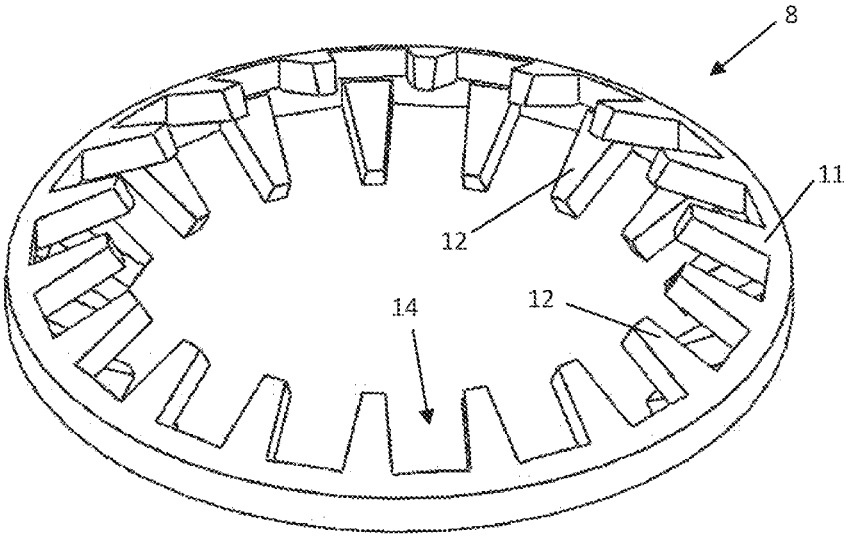
FIG. 8 shows a perspective view of a ring-shaped element having fragments projecting in different directions.

As shown in FIGS. 2 to 7, milling or punching allow to produce grooves 14, in particular of substantially rectangular cross-section, in a simple manner, wherein the ground 15' of the grooves may, alternatively, be designed in the shape of a circular arc (cf. FIGS. 2 to 4), an acute angle (cf. FIG. 5) or, however, rectilinear (cf. FIG. 7).

A particular material-saving production method has been used for element 8 shown in FIG. 6, in which grooves 14 having a comparably small cross-sectional width have been produced using wire erosion. As an alternative to wire erosion and/or milling or punching, the grooves may, of course, be produced by means of laser.

Figure 9:
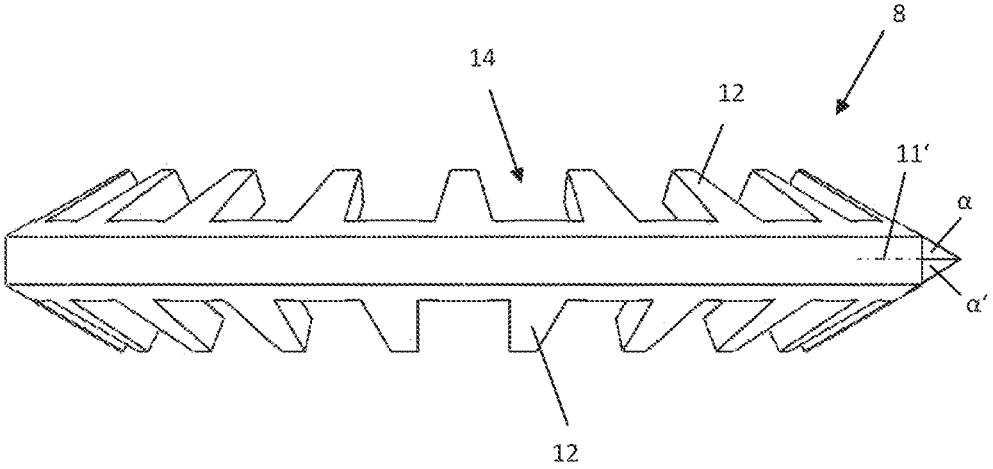
FIG. 9 shows a side view of the ring-shaped element according to FIG. 8.

A further alternative exemplary embodiment of the ring-shaped element 8 is shown in FIGS. 9 and 10, wherein the ring-shaped element 8 features two groups of fragments 12, with the one group of fragments 12 bent upwards with respect to an orthogonal plane 11' defined by the ring-shaped connecting portion and the other group of fragments 12 bent downwards.

The different orientations of these fragments 12 are selected alternating in the circumferential direction, so that, advantageously, equally designed ring-shaped elements 8 may be stacked intimately into each other in an orientation turned around a fragment 12.

As shown in FIG. 1, it is also possible, in particular, to allow different propelling directions, using ring-shaped elements 8 in which the fragments 12 are bent in only one direction with respect to the plane 11' defined by the ring-shaped connecting portion 11, by pushing the ring-shaped elements 8 over the cylindrical shell surface 7 in different spatial orientations. The two groups 10, 10' of ring-shaped elements 8 having different orientations are separated by the positioning ring 9, which has contact surfaces 9', 9" that are inclined according to the respective angle of inclination α of the fragments 12.

Tests showed that, depending on the selection of the explosive and the material of the ring-shaped elements 8, those elements 8 of group 10 which are located closer to the fuze, i. e. closer to the ground, are propelled in a scattering angle β of approx. 0° to 70° to the orthogonal plane 13', with the fragments 12 located near the positioning ring 9 and/or a central plane being propelled in a relatively small angle near the lower limit of the scattering angle β. Then, the propelling angle increases for the fragments 12 further away from the positioning ring 9 and/or a central plane, so the fragments 12 further away from the positioning ring 9—again depending on the selection of explosive and material—are propelled in an angle near the upper limit of the scattering angle β. The ring-shaped elements 8 of group 10', which are located closer to the rear part 3 of the projectile 2, have a scattering angle β' with a value of preferably also approx. 0° to 70° to the orthogonal plane 13', but in the opposite direction. As has been described above, the propelling angle of the fragments 12 increases the further the fragments are away from the positioning ring 9 and/or a central plane here as well, so advantageously there will be an effective propelling angle of up to 140° altogether.

As can be seen in FIG. 1, this leads to a considerably larger scattering angle for the fragments 12 of the ring-shaped elements 8 when compared to a uniformly orthogonal propelling direction, so the efficiency of the projectile 1 is clearly improved when compared to disc-shaped elements extending only in the orthogonal plane to the longitudinal axis 7' and/or 8'.

Furthermore, it can be seen in FIG. 1 that the ring-shaped elements 8 in their assembled state form a substantially smooth outer shell surface 16. Since, during stamping, the outer shell surface of the ring-shaped connecting portion 11 is initially also arranged inclined to the desired smooth shell surface 16 for inclining the fragments 12, the ring-shaped elements 8 are preferably glued to one another, and then sharp-edged protrusions having a substantially triangular cross-section are removed by a turning method, so the desired substantially smooth shell surface 16 is obtained. Afterwards, it may be provided with a paint layer or the like with regard to improved protection against corrosion.

Of course, ring-shaped elements 8 having different angles α and/or, to some extent, disc-shaped elements in which the fragments extend substantially in the direction of an orthogonal plane to the longitudinal axis 8' may also be provided in a projectile 2. The only substantial part is that at least some ring-shaped elements 8 are provided, in which the freely projecting ends 13 of the fragments 12 are arranged in an orthogonal plane 13' diverging from the orthogonal plane 11' defined by the ring-shaped connecting portion, so the scattering angle of the fragments 12 is increased.

The invention claimed is:

1. A projectile, which has a projectile body featuring a recess for receiving an explosive, wherein the projectile body has a cylindrical shell surface, at least in sections, which is surrounded, at least in sections, by several ring-shaped elements provided with predetermined break points, wherein fragments formed upon breakup of the elements are predefined via the predetermined break points, said fragments being connected to one another in a ring-shaped connecting portion for forming the ring-shaped element, characterised in that freely projecting ends of the fragments are at least partially arranged in a common orthogonal plane to a longitudinal axis of the ring-shaped element, wherein this orthogonal plane is arranged diverging from an orthogonal plane defined by the ring-shaped connecting portion and the ring-shaped elements of the two groups are pushed on the cylindrical shell surface in a different spatial orientation, and wherein a subset of the fragments includes a first angle (a) other than 90° with respect to the orthogonal plane defined by the ring-shaped connecting portion, and another subset includes a second angle (a'), also other than 90° with respect to the orthogonal plane defined by the ring-shaped connecting portion, wherein the second angle (a') is mirrored to the first angle (a) about a plane extending through a ring-shaped connecting portion.

2. The projectile according to claim 1, characterised in that an upper and a lower surface of at least a number of fragments are formed substantially smooth and parallel to one another, wherein the two surfaces include an angle (α) other than 90° with respect to the orthogonal plane, defined by the ring-shaped connecting portion, to the longitudinal axis.

3. The projectile according to claim 2, characterised in that all fragments include substantially a same angle (α) of inclination with respect to the orthogonal plane, defined by the ring-shaped connecting portion, to the longitudinal axis.

4. The projectile according to claim 2, characterised in that the upper and the lower surface of the fragments include an angle (α) between 5° and 70° with respect to a plane defined by the ring-shaped connecting portion.

5. The projectile according to claim 1 characterised in that each of the ring-shaped elements has a plurality of grooves representing predetermined break points.

6. The projectile according to claim 5, characterised in that longitudinal extension axes of each groove are substantially in the radial direction of the ring-shaped element.

7. The projectile according to claim 5, characterised in that the grooves have a substantially rectangular cross-section.

8. The projectile according to claim 5, characterised in that the grooves have a ground in the shape of a circular arc.

9. The projectile according to claim 5, characterised in that the grooves have a ground in the shape of an acute angle.

10. The projectile according to claim 6, characterised in that the grooves extend outwardly from an inner surface of the ring-shaped elements defined by an inner radius.

11. The projectile according to claim 1, characterised in that the ring-shaped connecting portion has a substantially full-faced outer shell surface.

12. The projectile according to claim 11, characterised in that the outer shell surface of the ring-shaped connecting portion has an angle other than 90° towards both an upper and a lower surface of the ring-shaped connecting portion, wherein the outer shell surface extends substantially parallel to the cylindrical shell surface of the projectile body.

13. The projectile according to claim 1, characterised in that a positioning ring is arranged between a first subset and a second subset of the ring-shaped elements.

14. The projectile according to claim 13, characterised in that the positioning ring has an upper and a lower contact surface extending inclined with respect to an orthogonal plane of the longitudinal axis of the rotation-symmetrical section of the projectile body, with the positioning ring preferably designed as a mirror image about a central orthogonal plane of the longitudinal axis of the rotation-symmetrical section.

* * * * *